US009821284B2

(12) United States Patent
Johns

(10) Patent No.: US 9,821,284 B2
(45) Date of Patent: Nov. 21, 2017

(54) SHAKER BAG MIXING ASSEMBLY

(71) Applicant: JPRO DAIRY INTERNATIONAL, INC., Oceanside, CA (US)

(72) Inventor: Garry Patrick Johns, Oceanside, CA (US)

(73) Assignee: JPRO DAIRY INTERNATIONAL, INC., Oceanside, CA (US)

( * ) Notice: Subject to any disclaimer, the term of this patent is extended or adjusted under 35 U.S.C. 154(b) by 203 days.

(21) Appl. No.: 14/739,851

(22) Filed: Jun. 15, 2015

(65) Prior Publication Data

US 2016/0038893 A1 Feb. 11, 2016

Related U.S. Application Data

(60) Provisional application No. 62/033,335, filed on Aug. 5, 2014.

(51) Int. Cl.

| | |
|---|---|
| ***B01F 13/00*** | (2006.01) |
| ***B01F 15/00*** | (2006.01) |
| ***B65D 75/58*** | (2006.01) |

(52) U.S. Cl.

CPC ..... *B01F 15/0085* (2013.01); *B01F 13/005* (2013.01); *B01F 13/0022* (2013.01); *B01F 15/00512* (2013.01); *B65D 75/5883* (2013.01)

(58) Field of Classification Search

CPC ..... B01F 13/0022; B01F 13/005; B01F 15/00512; B01F 15/0085; B65D 75/5883

USPC ..... 366/343, 342

See application file for complete search history.

(56) References Cited

U.S. PATENT DOCUMENTS

| | | | | | |
|---|---|---|---|---|---|
| 1,075,119 | A | * | 10/1913 | Reichner | A47J 19/022 215/390 |
| 1,312,569 | A | * | 8/1919 | Paige | B01F 11/0005 366/130 |
| 1,353,443 | A | * | 9/1920 | Wilson | B01F 11/0002 366/130 |
| 1,661,336 | A | * | 3/1928 | Katz | A47J 43/27 206/217 |
| 2,147,349 | A | * | 2/1939 | Piquerez | B65D 3/06 206/822 |
| 2,400,716 | A | * | 5/1946 | Sattler | B65D 35/10 222/107 |
| 2,500,611 | A | * | 3/1950 | Kereluck | A47J 19/022 220/212 |
| 2,678,196 | A | * | 5/1954 | Bear | B01F 13/002 241/170 |
| 2,682,355 | A | * | 6/1954 | Robbins | B65D 35/02 222/107 |

(Continued)

*Primary Examiner* — Tony G Soohoo

(74) *Attorney, Agent, or Firm* — Innovation Capital Law Group, LLP; Vic Lin

(57) ABSTRACT

A mixing assembly includes a bag of appropriate size, configuration, shape and material and a closable spout that may have extensions of various lengths, shapes and configurations to provide enhanced mixing of a component contained in the bag upon the addition of a second component. Once the closure of the spout is removed, the second component, typically a liquid such as water, milk, juice, chemical, oil substrate, or the like, can be added to the container for mixing. After the closure is refitted, the two components are mixed then consumed or dispensed, either by removing the closure or from a separate spout or nozzle fitted to the closure.

20 Claims, 11 Drawing Sheets

(56) References Cited

U.S. PATENT DOCUMENTS 2,999,627 A * 9/1961 Reinhardt ..... B65B 9/14 206/525
3,065,898 A * 11/1962 Daugherty ..... B65D 35/02 222/95
3,204,283 A * 9/1965 Damron ..... A45D 34/048 366/243
3,288,334 A * 11/1966 Corsette ..... B05B 11/0043 222/107
3,326,533 A * 6/1967 Sturrup ..... A45D 34/048 366/242
3,456,923 A * 7/1969 Zeuzem ..... A45D 34/048 366/243
3,615,712 A * 10/1971 Keller ..... B65D 81/3415 206/484
3,677,524 A * 7/1972 Douglas ..... A47J 43/27 215/13.1
3,747,414 A * 7/1973 Ohno ..... G01F 19/00 215/11.1
3,820,692 A * 6/1974 Swett et al. ..... B65D 47/0895 222/547
3,851,814 A * 12/1974 Stage ..... B31B 19/00 206/439
4,003,555 A * 1/1977 Swartz ..... A47J 43/27 220/568
4,126,249 A * 11/1978 Wood ..... B65D 35/08 222/92
4,193,698 A * 3/1980 Gartner ..... B01F 7/0005 206/219
4,452,378 A * 6/1984 Christine ..... B65D 75/5883 222/107
4,641,974 A * 2/1987 Church ..... B01F 13/002 366/130
4,658,434 A * 4/1987 Murray ..... B32B 15/08 383/66
4,669,124 A * 5/1987 Kimura ..... B65D 41/34 206/807
4,718,778 A * 1/1988 Ichikawa ..... B65D 75/5883 220/705
4,783,176 A * 11/1988 Ichikawa ..... A45F 3/20 206/217
D307,385 S * 4/1990 Kimura ..... 383/80
4,913,561 A * 4/1990 Beer ..... B65D 31/10 383/120
4,916,672 A * 4/1990 McCrory ..... B01F 7/00583 366/130
4,978,025 A * 12/1990 Fougeres ..... B65D 31/12 222/105
5,139,168 A * 8/1992 Gueret ..... B05B 11/0043 222/105
D339,284 S * 9/1993 Gryczkowski ..... D9/703
5,353,964 A * 10/1994 Liu ..... A61J 7/0046 215/11.4
5,373,965 A * 12/1994 Halm ..... B65D 35/02 222/107
5,542,922 A * 8/1996 Petterson ..... A61J 9/00 215/11.1
5,547,275 A * 8/1996 Lillelund ..... A47J 43/27 215/DIG. 8
5,660,477 A * 8/1997 Ichikawa ..... B29C 66/53263 222/211
5,788,369 A * 8/1998 Tseng ..... A61J 9/00 215/11.2
6,030,652 A * 2/2000 Hanus ..... B65D 81/3469 383/120
6,073,804 A * 6/2000 Yquel ..... B05B 11/0043 222/105
6,105,821 A * 8/2000 Christine ..... B65D 77/065 222/105
6,220,702 B1 * 4/2001 Nakamura ..... B41J 2/17503 206/524.8
6,241,122 B1 * 6/2001 Araki ..... B65D 47/06 222/107
6,379,032 B1 * 4/2002 Sorensen ..... B01F 13/002 366/130
D474,682 S * 5/2003 Berman ..... D9/708
D476,522 S * 7/2003 Renz ..... D7/376
6,616,319 B2 * 9/2003 Renz ..... A61J 9/00 215/11.1
D490,303 S * 5/2004 Berman ..... D9/708
D497,544 S * 10/2004 Berman ..... D9/708
6,832,852 B2 * 12/2004 Wilkes ..... B29C 66/8221 222/107
D504,610 S * 5/2005 Berman ..... D9/708
D505,066 S * 5/2005 Ootubo ..... D9/709
D508,413 S * 8/2005 Ueda ..... D9/708
D513,417 S * 1/2006 Ishizawa ..... 347/86
D525,144 S * 7/2006 Risgalla ..... D9/707
D526,573 S * 8/2006 Ueda ..... D9/702
D527,278 S * 8/2006 Ueda ..... D9/702
D528,011 S * 9/2006 Ueda ..... D9/702
7,159,742 B2 * 1/2007 Lee ..... B65D 75/008 222/173
D551,289 S * 9/2007 Otsuka ..... 347/86
D560,122 S * 1/2008 Fuchs ..... D9/708
8,201,688 B2 * 6/2012 Burfiend ..... A47K 5/18 206/277
8,573,445 B2 * 11/2013 Murray ..... B65D 75/5883 222/107
D705,080 S * 5/2014 Ootubo ..... D9/430
8,777,058 B2 * 7/2014 Haefele ..... B65D 35/14 222/105
D729,071 S * 5/2015 Bradley ..... D9/705
9,321,558 B2 * 4/2016 Callahan ..... B65D 33/02
D762,015 S * 7/2016 Pietrocarlo ..... D30/121
D766,734 S * 9/2016 Fitzsimmons ..... D9/709
2001/0027984 A1 * 10/2001 Ichikawa ..... B65D 75/5883 222/464.3
2002/0063140 A1 * 5/2002 Croft ..... B65D 75/5811 222/129.1
2003/0012851 A1 * 1/2003 Kuge ..... B65D 31/06 426/85
2003/0075560 A1 * 4/2003 Lee ..... B65D 75/5822 222/92
2003/0205583 A1 * 11/2003 Provenza ..... B65D 77/062 222/105
2004/0217126 A1 * 11/2004 Lee ..... B65D 75/5883 222/78
2005/0029290 A1 * 2/2005 Lee ..... B65D 75/008 222/92
2006/0113319 A1 * 6/2006 Smith ..... B65D 77/065 222/105
2008/0135513 A1 * 6/2008 Umenaka ..... B65D 75/5883 215/252
2008/0137998 A1 * 6/2008 Burfiend ..... A47K 5/18 383/120
2008/0166074 A1 * 7/2008 Anderson ..... B65D 75/5883 383/42
2009/0095369 A1 * 4/2009 Murray ..... A23L 3/02 141/5
2009/0162133 A1 * 6/2009 Haefele ..... B65D 35/14 401/282
2010/0089488 A1 * 4/2010 Veenendaal ..... B65D 77/06 141/2
2012/0170876 A1 * 7/2012 Kuge ..... B31B 37/00 383/120
2014/0376834 A1 * 12/2014 Callahan ..... B65D 33/02 383/119

* cited by examiner

SHAKER BAG MIXING ASSEMBLY

RELATED APPLICATIONS

This application relates to, claims priority from, and incorporates herein by reference, as if fully set forth, the following:

1) U.S. Provisional Patent Application Ser. No. 62/033,335 filed on Aug. 5, 2014 and entitled "SHAKER BAG MIXING ASSEMBLY".

BACKGROUND OF THE INVENTION

1. Field of the Invention

The invention relates generally to containers, and more particularly to a shaker bag mixing assembly that is well suited for mixing one or more dry ingredients with an introduced liquid.

2. Description of Prior Art and Related Information

Frequently, materials that are to be placed in use must be compounded or mixed just prior to use because one or both materials are not stable, must be maintained in a sterile environment, are reactive with air and/or water, or the like. Such materials include pharmaceuticals, medical supplies, food products, nutritional products, flavored milk or protein powders, gravies, dressings, puddings, soups, biological media, chemical compositions and the like, in the personal, medical, restaurant, food service, aid and disaster relief fields. These are typically referred to as two-component compositions. Frequently one component must be maintained in the sealed state for stability, sterility, or the like. The other component frequently is stable and can be a solvent, such as water, alcohol, milk, juice and the like.

Traditionally, two-component compositions are furnished in two separate containers. One or both of the containers may be sealed to maintain its respective contents in a sealed environment. To mix the composition, the sealed containers are broken open and the contents are combined in one of the containers or in a separate container.

Existing containers are not ideal. One major drawback is that containers, mechanical mixers, shaker bottles or blenders need to be washed, sterilized and dried before use. For example, in the preparation of milk shakes, protein drinks, or infant formula, both components must be measured or weighed and blended in a blender or shaker bottle or the like. This requires a number of containers and utensils that must be cleaned, sterilized and dried to avoid the possibility of contamination. Such conventional methods are not portable for preparation at the time of usage. Further, the exact measurement of the "active ingredient(s)" is often done by volume measurement and is not necessarily accurate.

In the case of certain products, and particularly nutritional and protein powders, the addition of water, milk or juice to a powder can be difficult to mix. Therefore, blenders and shaker bottles, including various mixing devices as mentioned above, are required. Further, water or milk added on top of the powdered ingredient causes clumps and lumps which are difficult to mix. The addition of a powdered ingredient on top of the liquid (water, milk or juice) can avoid these problems but has not proven practical.

Existing liquid Ready to Drink (RTD) products are usually sterilized under severe heat treatment conditions, with processing aids such as emulsifies, stabilizers or preservatives causing flavor and ingredient degradation during the heat treatment process and during the course of distribution, thus limiting shelf life. Packaging of these products requires specific material and structural design to accommodate the heat treatment process, such as expensive and environmentally unfriendly plastic materials. Further, limitations exist in the manufacture and marketing of products that contain bioactive, or non-heat stable ingredients due to complete or partial degradation, high viscosity, settling or even gelation of the product.

Existing laminated bags and sachets made from various plastics or foil laminates are available typically with a spout having a 5 mm to 10 mm internal diameter including a tamper proof cap typically used for liquid fruit juices, purees, juice drinks and the like. Powdered single serve sachets do not have a spout for filling or direct consumption and require the bag or sachet to be opened and the contents added to another container, or blender for mixing and preparation before usage.

There is a need for a container which can provide the appropriate size, shape, configuration and mixing attributes that may or may not include a mixing device, to which one component can be pre-measured and sealed until a second component is added at a predetermined volume or weight at the time of usage. Such container must be of suitable material, low cost, typically disposable and have an opening large enough to fill powdered components with automated machinery and for adding the second component. Such container should also be lightweight and be of minimum foot print and low volume to permit efficient packaging of the dried components for shipment and consumer convenience.

SUMMARY OF THE INVENTION

Embodiments of the present invention provide structures and methods which overcome the deficiencies of the prior art, including liquid (RTD) packaging for dried powdered products in laminated bags, sachets and the like.

Embodiments of the present invention provide structures and methods that relate to a mixing assembly which includes a bag of appropriate size, configuration, shape and material with a closable spout that may have extensions of various lengths, shapes and configurations to provide enhanced mixing of a component contained in the bag upon the addition of a second component Embodiments of the present invention provide for a disposable container and spout of appropriate size, configuration, shape and mixing attributes that may or may not include a mixing device, to which one component can be accurately pre-measured and sealed until a second component is added to a predetermined level or by weighing at the time of usage. Embodiments of the present invention allow the addition of a liquid, such as water, to be added on top of a powdered ingredient and mixed which has not been possible to date.

Embodiments of the present invention provide for a spout fitment of at least 15 mm, typically from about 20 mm to about 40 mm internal diameter, in order to permit the ingredients to be filled with typical powder filling equipment at predetermined exact weight measurement and for the second component (liquid) to be readily added into the container. Additionally, the spout or closure may have an integral or separately fitted extension that protrudes below the spout into the bag. The extensions may be any design that enhances the mixing of the powder with the liquid. This may include a simple flat bar/paddle, cross bar, mesh or multiple bars or more sophisticated "static" mixing designs applicable to the product. Such extension or mixing device can be designed to permit normal filling of the bag and maintain a flat bag during shipping for consumer convenience until time of preparation. Further, the mixing device may be a collapsible/retractable device that can be inserted into the container through the wide opening which, upon entering the container, opens out such that it does not block the opening or exit of the container upon consumption or dispensing. Because of the wide diameter spout, this mixing device can be shaped and can be of sufficient mass to be an effective aid in mixing.

In one aspect, the design of the container is unique and critical to the effective mixing of many products. In the preparation and mixing of many powdered products, it is usual to add the powder to the liquid component to facilitate good mixing. For many products, the addition of water to the powder results in clumps of powder lodging in the bottom of the container. Embodiments of the present invention avoid these problems due to the design and shape of the bag, which permits the water to filtrate and traverse around the product to avoid clumping as is experienced in conventional flexible packaging containers, typical water bottles, other like containers or shaker bottles that commonly require a mixing device.

In another aspect, the present invention provides for a range of possible mixing devices as an integral or separate fitting to the container for products that may require specialized mixing procedures. Examples include pancake or batter mixes that should not be over mixed.

In another aspect, the present invention provides the benefits of a single serve delivery system that is convenient, light weight and functional for typical serving sizes or preparation quantities in powdered form. The preferred embodiments avoid issues with shelf life, product degradation, and food additives particularly for proteins, bioactive compounds, vitamins, minerals, probiotics, taste, flavor and the like due to the absence of secondary processing involving high temperatures. Embodiments of the present invention circumvent these issues by providing the appropriate packaging material, sizing, and construction for enhanced mixing conditions to facilitate a convenient and functional preparation system.

In another aspect, the flexible characteristics permit the components to be massaged if necessary to break any lumps or clumps.

In another aspect, the quantity of liquid to be added to the container can be accurately weighed, marked on the package or, for some products, filled to the top without the consumer having to be concerned with adding too much liquid, resulting in an over diluted product. Further, the container, because of the spout sizing, permits easy pouring of water, milk, juice or other liquids into the container.

Current single serve delivery systems for some powdered products are typically offered in stick packs or sachet bags that require opening, by tearing or cutting, then pouring the powder into a bottle or glass. This can result in spillage and/or require special mixing utensils. Embodiments of the present invention avoid these steps, requiring the consumer, technician or practitioner to conveniently and readily add the appropriate liquid, mix, and, following consumption or usage, dispose of the container and avoid cleaning and sterilization of additional containers and utensils.

In another aspect, the container is light weight, stacks efficiently and offers economic benefits in shipping and distribution given that only the solid components of the product are transported.

It is one aspect of the present invention to provide a mixing assembly that comprises a bag having an interior for containing a product therein; a spout fluidly connecting with the interior of the bag; an expandable side gusset forming sides of the bag; and a bottom portion of the bag that omits a flat surface and lacks gussets.

Another aspect of the present invention is to provide a mixing assembly that comprises a bag having an interior for containing a product therein; a spout fluidly connecting with the interior of the bag; a closure removable disposed on the spout; an expandable side gusset forming sides of the bag; a bottom portion of the bag that omits a flat surface and lacks gussets; and rounded side portions connecting the sides of the bag with the bottom portion, wherein the spout has an internal diameter of at least 15 millimeters.

An additional aspect of the present invention is to provide a mixing assembly that comprises a bag having an interior for containing a product therein; a spout fluidly connecting with the interior of the bag; a closure removable disposed on the spout; an expandable side gusset forming sides of the bag; a bottom portion of the bag that omits a flat surface and lacks gussets; rounded side portions connecting the sides of the bag with the bottom portion; and a mixing device disposed within the bag, wherein the spout has an internal diameter of at least 15 millimeters.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
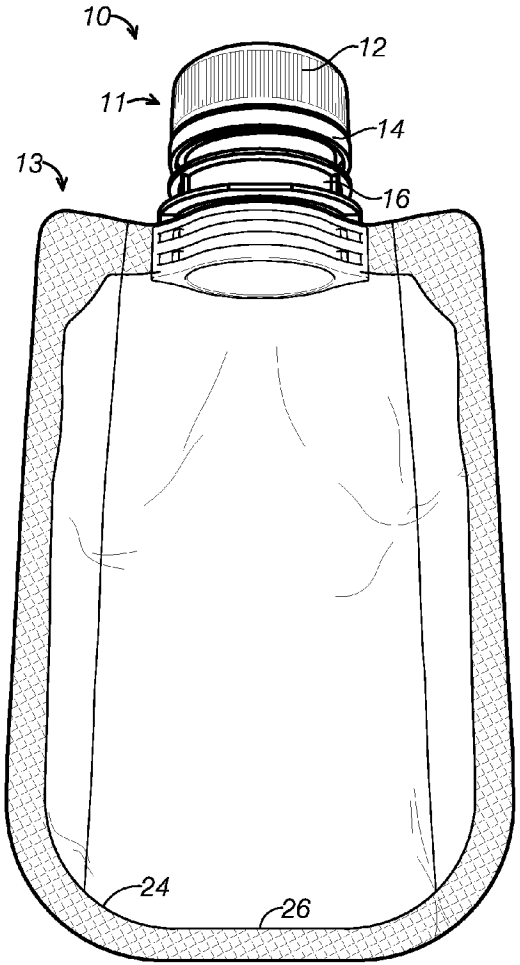
FIG. 1A shows a front perspective view of a shaker bag mixing assembly according to an exemplary embodiment of the present invention.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Referring now to FIGS. 1A through 1F, a preferred embodiment of a shaker bag mixing assembly 10 (also referred to as mixing assembly 10, or assembly 10) includes a bag 13 made from single or laminated materials, a spout assembly 11 providing fluid communication to an interior of the bag 13, and a closure 12. The bag 13 can be molded to the spout assembly 11. In one embodiment, the width of the bag 13 is 107 mm, the length of the bag is 160 mm and an internal width of a side gusset 18 is 22 mm. Alternatively, the width of the bag 13 could be as little as 80 mm and up to 150 mm, for example. Alternatively, the length of the bag may be decreased to about 75% of the width of the bag 13 or increased to about 200% of the width of the bag 13 before mixing and convenience is compromised. Alternatively, the internal width of the side gusset 18 may be increased or decreased within a range of about 25% to about 50% of the width of the bag 13 to optimize product characteristics and volume requirements.

As shown in FIG. 1A, a bottom portion 26 of the bag 13 preferably omits flat corners and a flat horizontal surface. In other words, the bottom portion 26 preferably omits gussets like the side portions. By omitting a flat bottom surface, mixing is enhanced as the dry ingredients are prevented from settling on flat horizontal surface. In some embodiments, the bottom portion 26 may connect to the side gussets 18 with a rounded corner 24, as shown in FIGS. 1A and 1F, for example, in order to avoid a linear corner. In some embodiments, a sealing angle on each side of the bag 13 can form a series of V-shaped surfaces at the bottom portion 26 of the bag to omit any flat horizontal surface for the mixture to settle and cause mixing problems. In some embodiments, an interior of the bag can be formed entirely rounded, lacking any inside linear edges or angles into which product may accumulate and not by appropriately mixed.

Figure 1B:
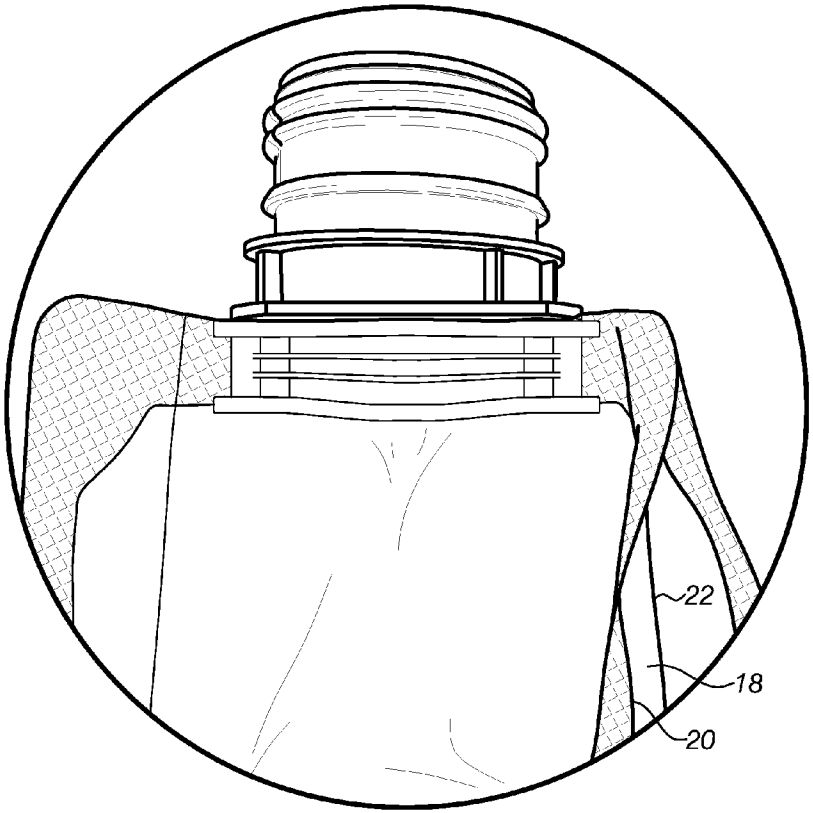
FIG. 1B shows a detailed perspective view of an upper portion of the shaker bag mixing assembly of FIG. 1A, illustrating side gussets according to an exemplary embodiment of the present invention.
Figure 1C:
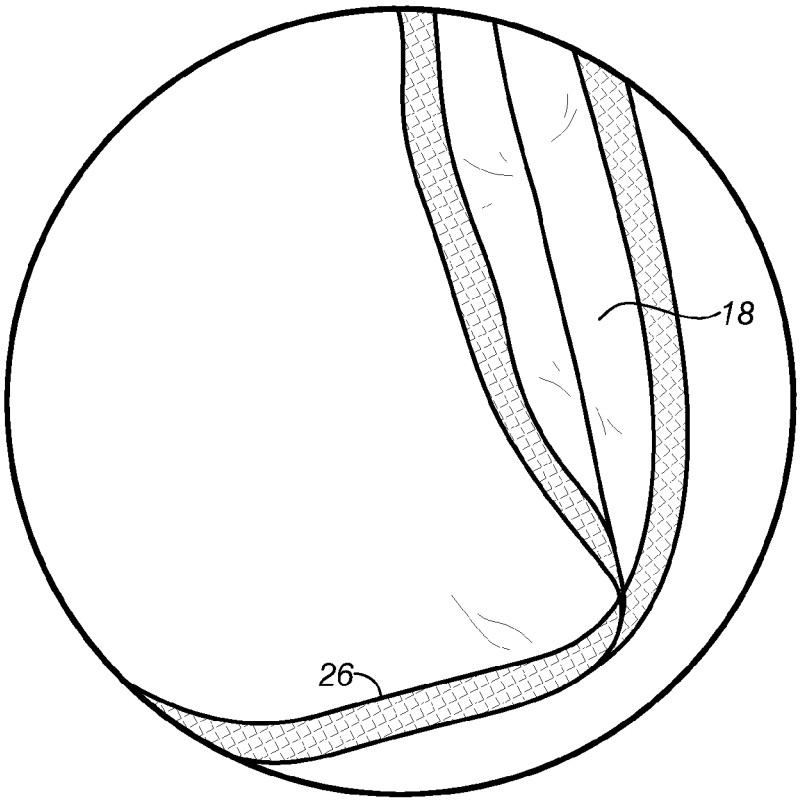
FIG. 1C shows a detailed perspective view of a lower portion of the shaker bag mixing assembly of FIG. 1A, illustrating side gussets according to an exemplary embodiment of the present invention.
Figure 1D:
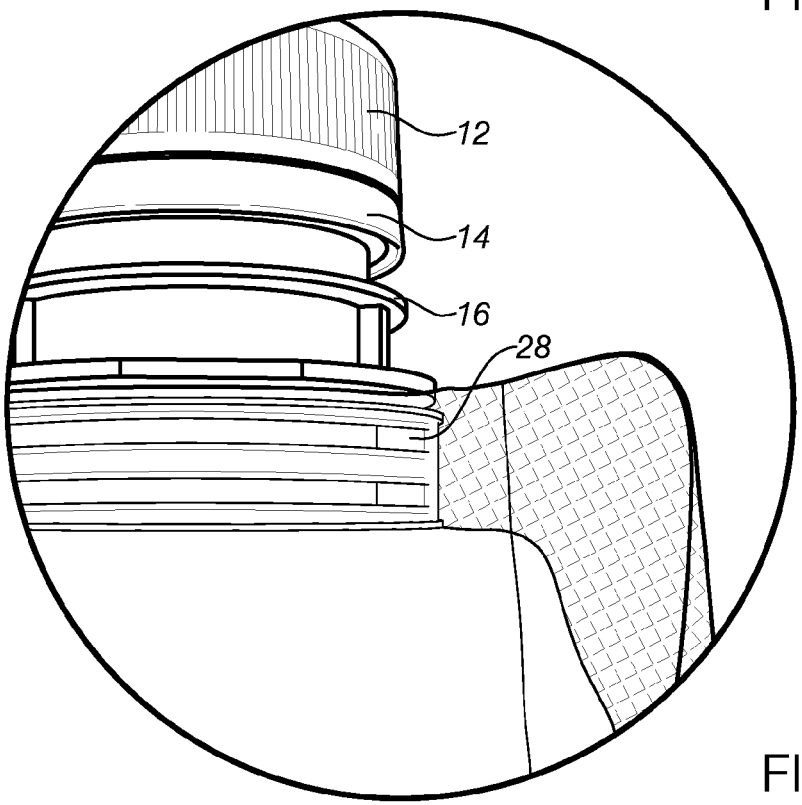
FIG. 1D shows a detailed front view of a cap assembly for the shaker bag mixing assembly of FIG. 1A.
Figure 1E:
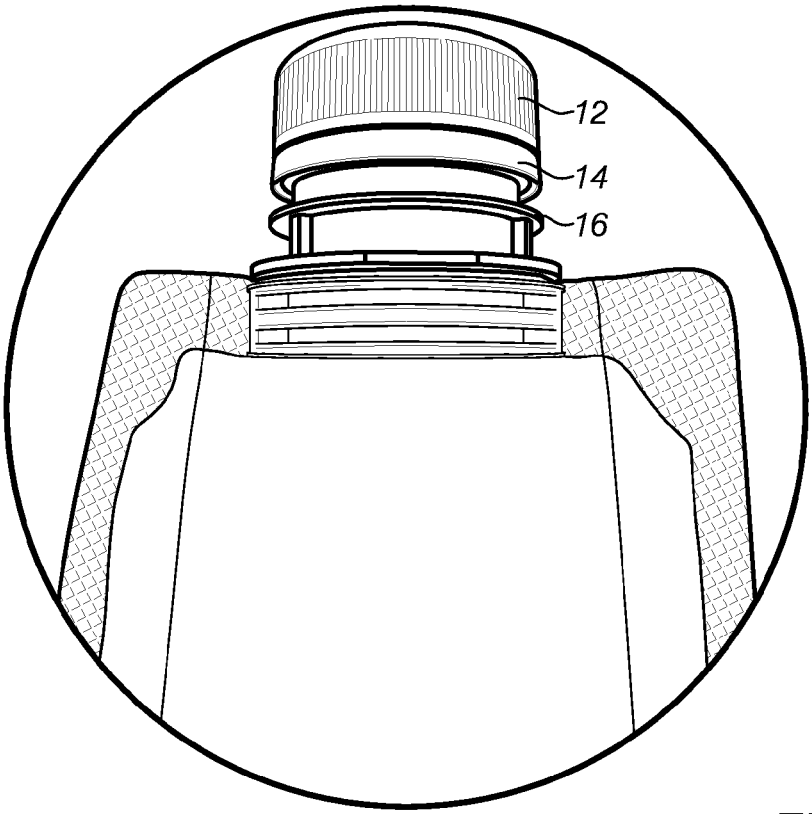
FIG. 1E shows a front view of the cap assembly and upper container design for the shaker bag mixing assembly of FIG. 1A.
Figure 1F:
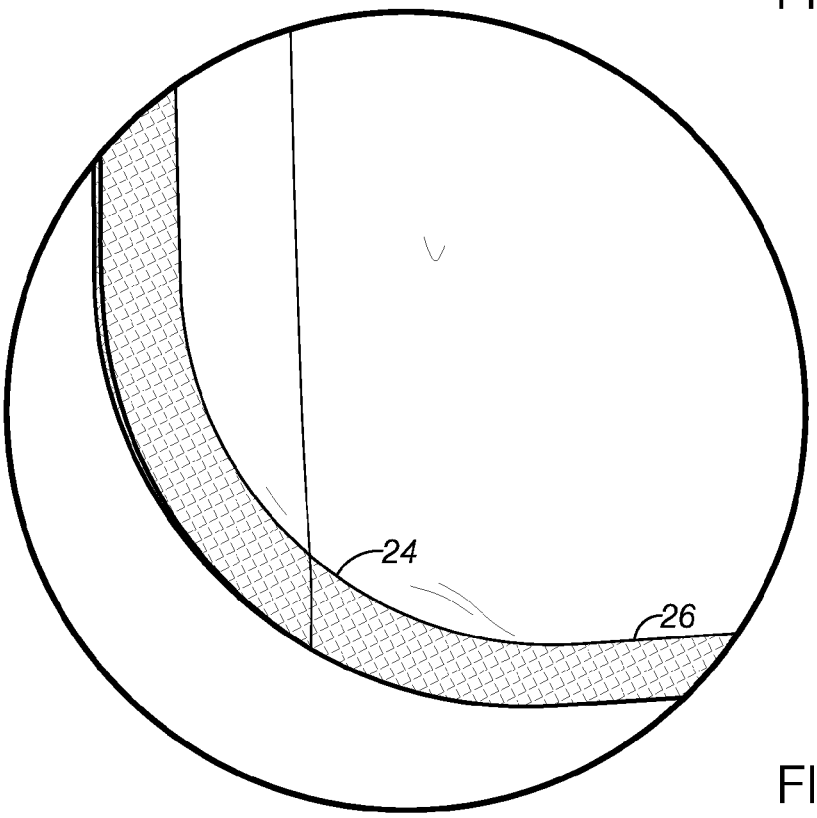
FIG. 1F shows a detailed front view of the shaker bag mixing assembly of FIG. 1A, illustrating rounded bottom corners thereof.
Figure 2A:
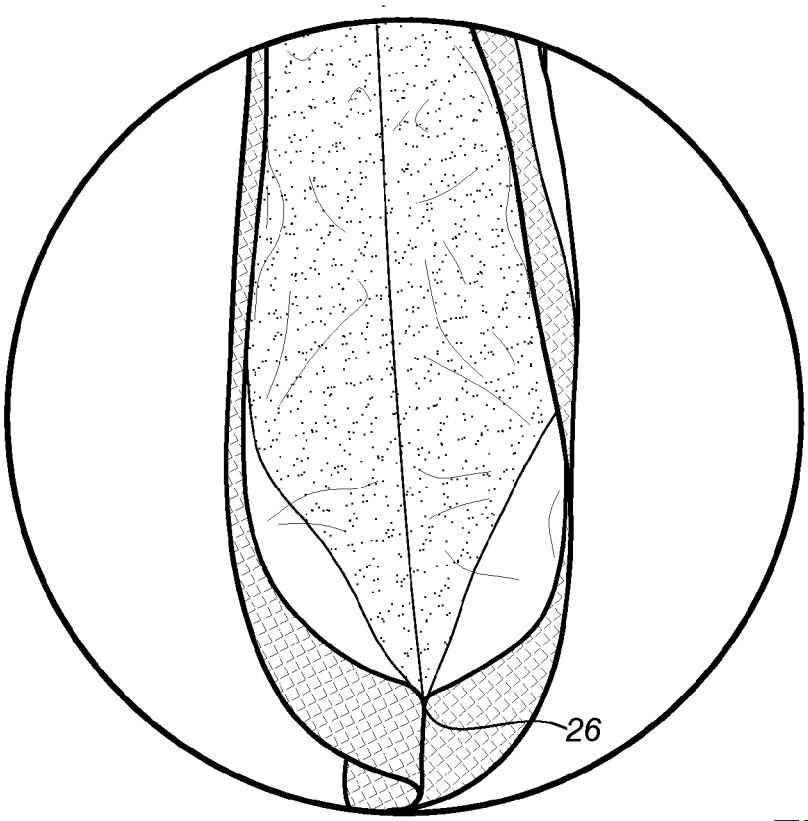
FIG. 2A shows a side view of the shaker bag mixing assembly of FIG. 1A having a product contained therein.
Figure 2B:
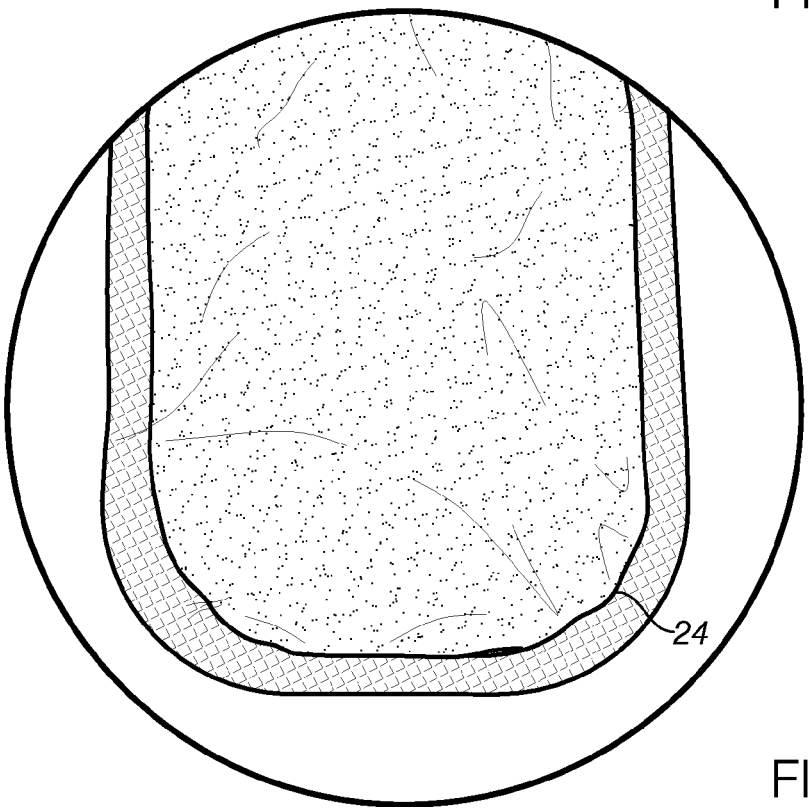
FIG. 2B shows a front view of the shaker bag mixing assembly of FIG. 1A having a product contained therein.

As shown in FIG. 1B, the side gusset 18 may attach to front and rear portions of the bag 13 at a seam 20 and may include a central fold 22 so that the bag 13 may lie flat when not filled with product.

In some embodiments, the width of the bag 13 can be about 40 mm determined by a 40 degree angle on each side of the bag 13. Alternatively, the internal width of the bottom of the bag may be no greater than 50% of the width of the bag 13 or an angle at each side of the bag 13 of no less than 20 degrees.

In an exemplary embodiment, a spout 16 has an internal diameter of 30 mm and a typical thread to allow the closure 12 to be fitted to seal the bag. The spout 16 diameter may be adjusted to 15-35 mm for alternative applications. The spout 16 may connect to the bag 13 at a connection point 28. The connection at the connection point 28 may be formed by various processes, such as heat seal, food-safe adhesive, or the like. The closure 12 can be fitted with a tamper evidence breakaway or tear away seal 14 that locks onto the closure 12 by ratchets or a circular ring that, upon opening of the closure 12, breaks and allows the closure 12 to be removed. Alternatively, the closure 12 may be made tamper evident by applying a shrink seal band for the end user to remove prior to usage.

A typical embodiment has a volume of 275 cc or approximately 10 ounces. This may be varied depending on the various parameters mentioned above as well as the desired application. As examples and not by way of limitation, the preferred embodiments may comprise a volume capacity of 3 ounces to 3 pounds.

Exemplary embodiments, as described above, are optimized for a protein nutritional drink which can be difficult to mix. Due to the sizing, shape and structure of the embodiments described above, the combination of factors allows the liquid (water, milk or juice) to mix with the powdered ingredient, initially dispersing the liquid into and around the powdered ingredients and, upon shaking by hand in a motion horizontally in the direction of the gussets, causes the components to readily mix through the action of the effect of the shape of the bottom and the side gussets of the bag, providing adequate surface area and a shearing effect.

Figure 3A:
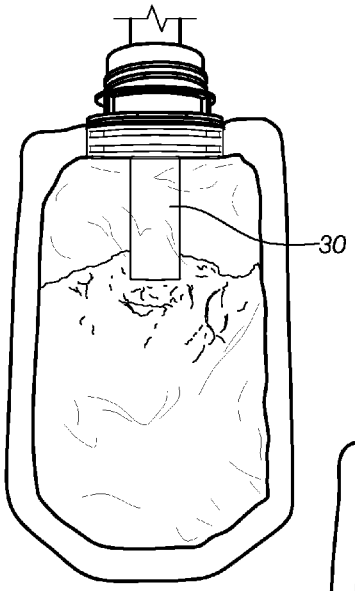
FIGS. 3A through 3D illustrate exemplary steps of filling, adding a liquid, mixing of a protein powder drink and interlock stacking for distribution of a shaker bag mixing assembly according to an exemplary embodiment of the present invention.
Figure 3B:
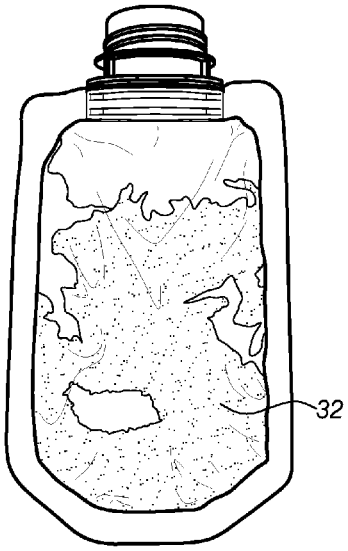
Figure 3C:
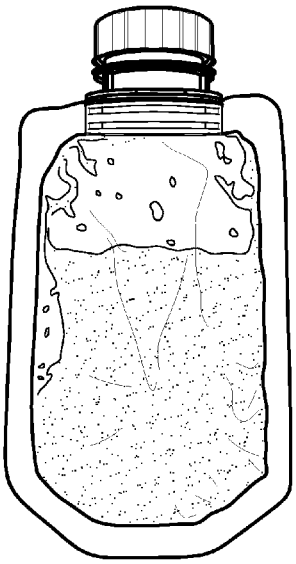
Figure 3D:
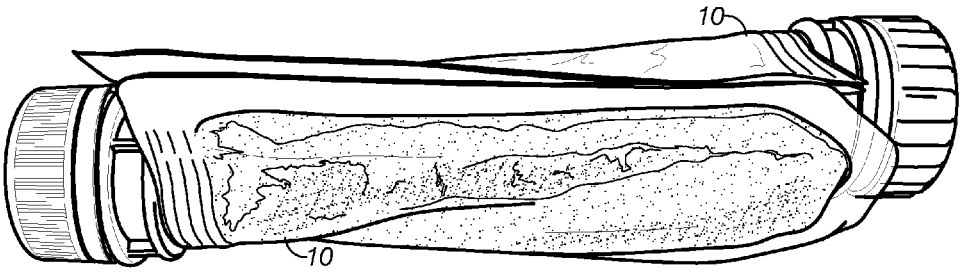

Referring now to FIGS. 3A through 3D, an exemplary embodiment of the present invention may be used for a nutritional drink, where a powdered ingredient 32 is filled into the bag 13 through the spout 16 by a filling auger/dispenser 32. FIG. 3D shows two assemblies 10 filled, with the closure 12 fitted, and stacked in an interlocking configuration for distribution to the consumer. FIG. 3B shows the liquid (such as water) added to the bag 13, noting the interface of the liquid with and around the powdered ingredient 32. FIG. 3C shows the mixed ingredients, ready to drink upon removal of the closure 12.

Figure 4B:
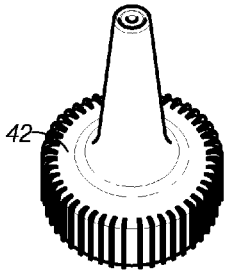
FIGS. 4A through 4C illustrate examples of optional closure caps with drinking or pouring nozzle features.
Figure 4A:
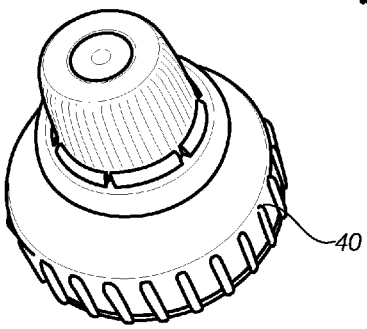
Figure 4C:
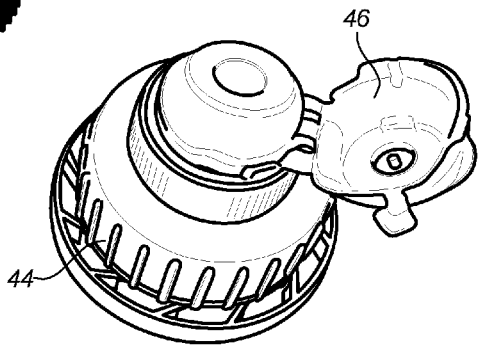
Figure 5A:
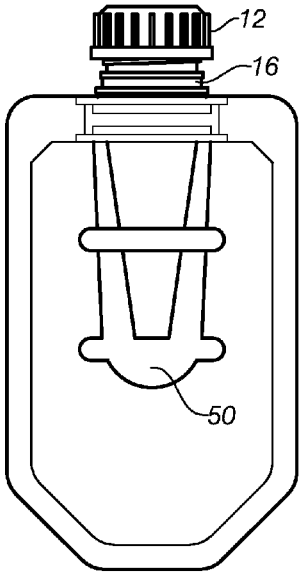
FIGS. 5A through 5D show cross sectional views of examples of optional mixing devices as an integral part of the spout molded part, according to exemplary embodiments of the present invention.
Figure 5B:
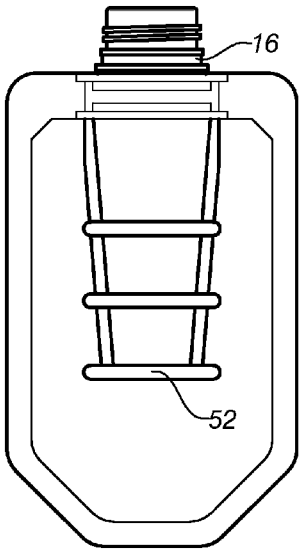
Figure 5C:
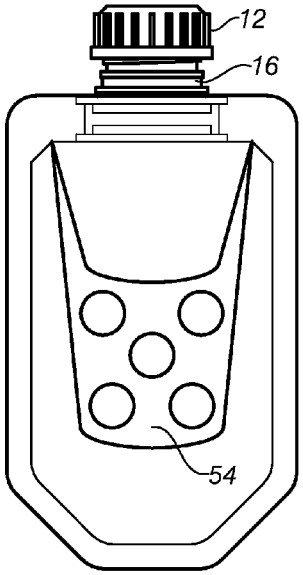
Figure 5D:
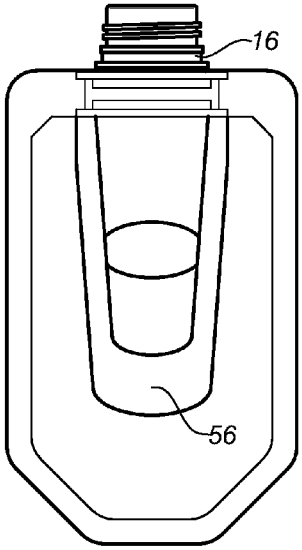

Referring to FIGS. 4A through 4C, alternative embodiments to the closure design include closures of various tamper proof construction arrangements and drinking, pouring or nozzle features. Specific non-limiting examples include a pull-spout closure 40, a squirt-spout closure 42, and a closure 44 with a flip-top 46. Closures fitted with a venting membrane can be included to accommodate pressure conditions such as altitude, carbonation, autoclaving and retorting.

Exemplary embodiments of the present invention provide for a structure and configuration that permits a lightweight and efficient stacking configuration for shipping and distribution. The use of lightweight laminated films provides for suitable moisture and product protection barriers, high quality graphic art, ease of handling and flexibility for consumer convenience. A typical embodiment may be structured with 0.1 mm film made of a laminated polyethylene terephthalate (PET) polyethylene film (PE) films. Other materials and thicknesses maybe used for light, moisture barrier and printing requirements. The configuration and structure permits the reverse interlocking of a finished product for efficient and low cost distribution due to the wedge shape of the package from less than 1 mm at the bottom progressing to 40-50 mm dependent on the selection of cap closure style. The volume of the powdered ingredient during distribution is optimized within the flat and wedged structure as shown in FIG. 3D, for example. The application of the side gussets is realized during the addition of the liquid component to provide the necessary liquid volume and for the mixing process.

Referring now to FIGS. 5A through 5D, an integrated mixing device 50, 52, 54, 56 may be designed as an integral part of the spout 16. The integrated mixing device 50, 52, 54, 56 can extend into the bag 13 at any desired length and design configuration as discussed above. FIGS. 5A through 5D show just four of the many possible configurations which may be included within the scope of these embodiments. Other designs are possible at any desired length, width or orientation. These embodiments may include the alternative embodiments mentioned above and shown in FIGS. 4A through 4C, for example, which may or may not include a venting membrane as mentioned above.

Figure 6:
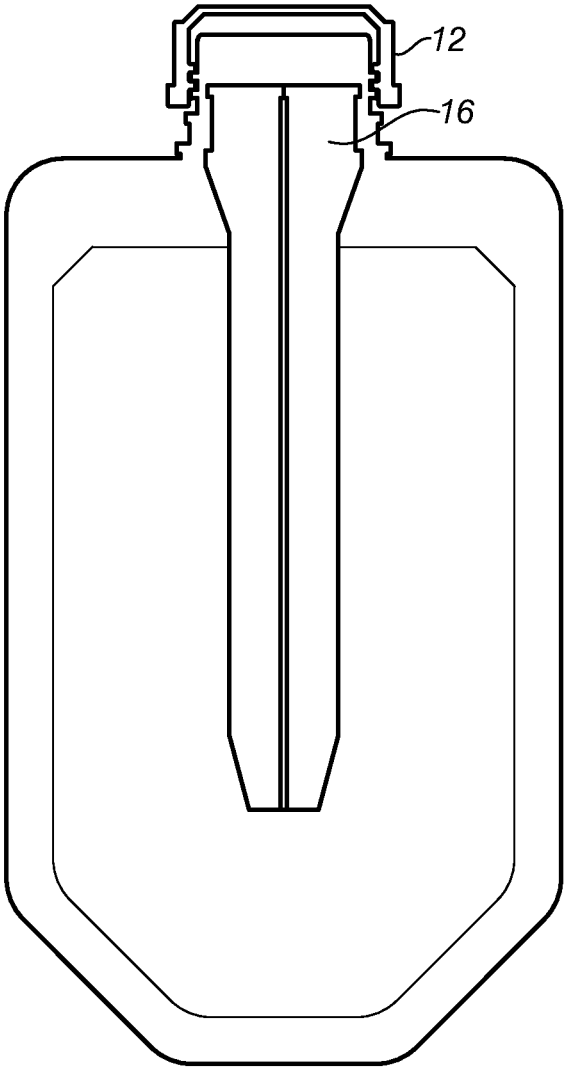
FIG. 6 shows a cross sectional view of an example of separate component mixing device that can be pressure fitted to the spout or the closure, according to an exemplary embodiment of the present invention.
Figure 7A:
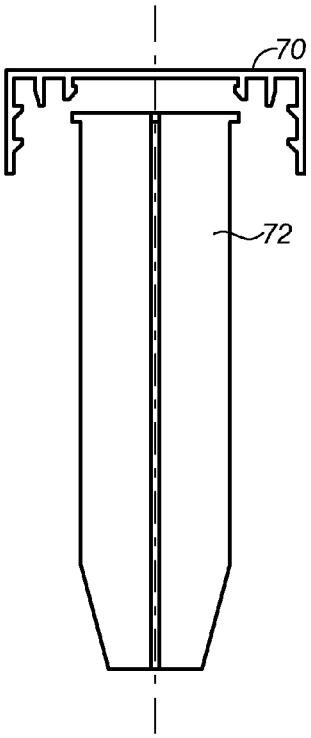
FIG. 7A is a side cross sectional view of an optional mixing device as an integral part of the closure cap, according to an exemplary embodiment of the present invention.
Figure 8A:
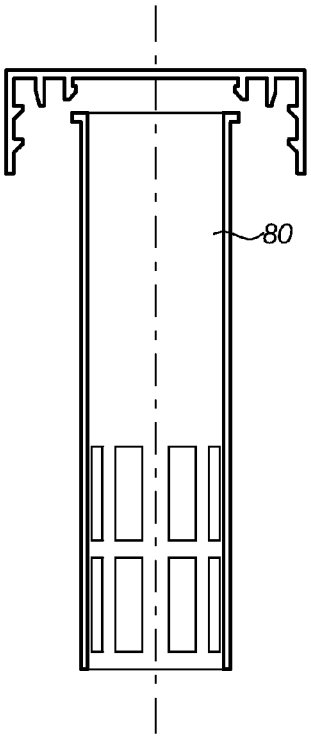
FIG. 8A is a side cross sectional view of an optional mixing device as an integral part of the closure cap, according to an exemplary embodiment of the present invention.
Figure 7B:
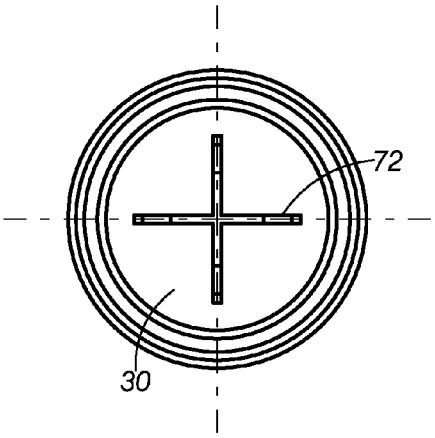
FIG. 7B is a top cross sectional view of the optional mixing device of FIG. 7A.
Figure 8B:
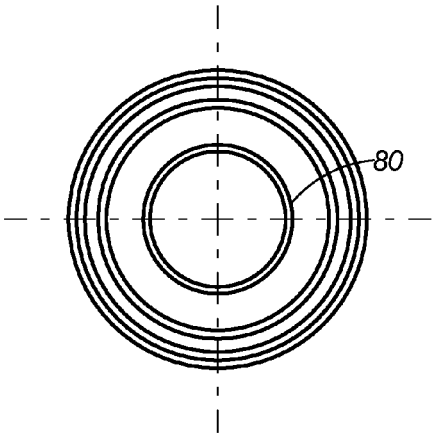
FIG. 8B is a top cross sectional view of the optional mixing device of FIG. 8A.

Referring to FIG. 6, a separate mixing device 60 may be a separate component fitted to the spout 16. The separate mixing device 60 may be locked to the spout 16 by way of a pressure fit, for example, and may be added prior to or after the filling of the bag 13 and before the fitting of the closure 12. The assembly 10 that includes the separate mixing device 31 may include variations of dimension and shape as discussed above. Other designs are possible at any desired length, width or orientation.

Referring to FIGS. 7A, 7B, 8A and 8B, a closure-fitted mixing device 72, 80 may be a separate component fitted to a closure cap 70. Such embodiments may include variations of dimension and shape as discussed above. Other designs are possible at any desired length, width or orientation. This embodiment may include a venting membrane closure, as described above.

Figure 9:
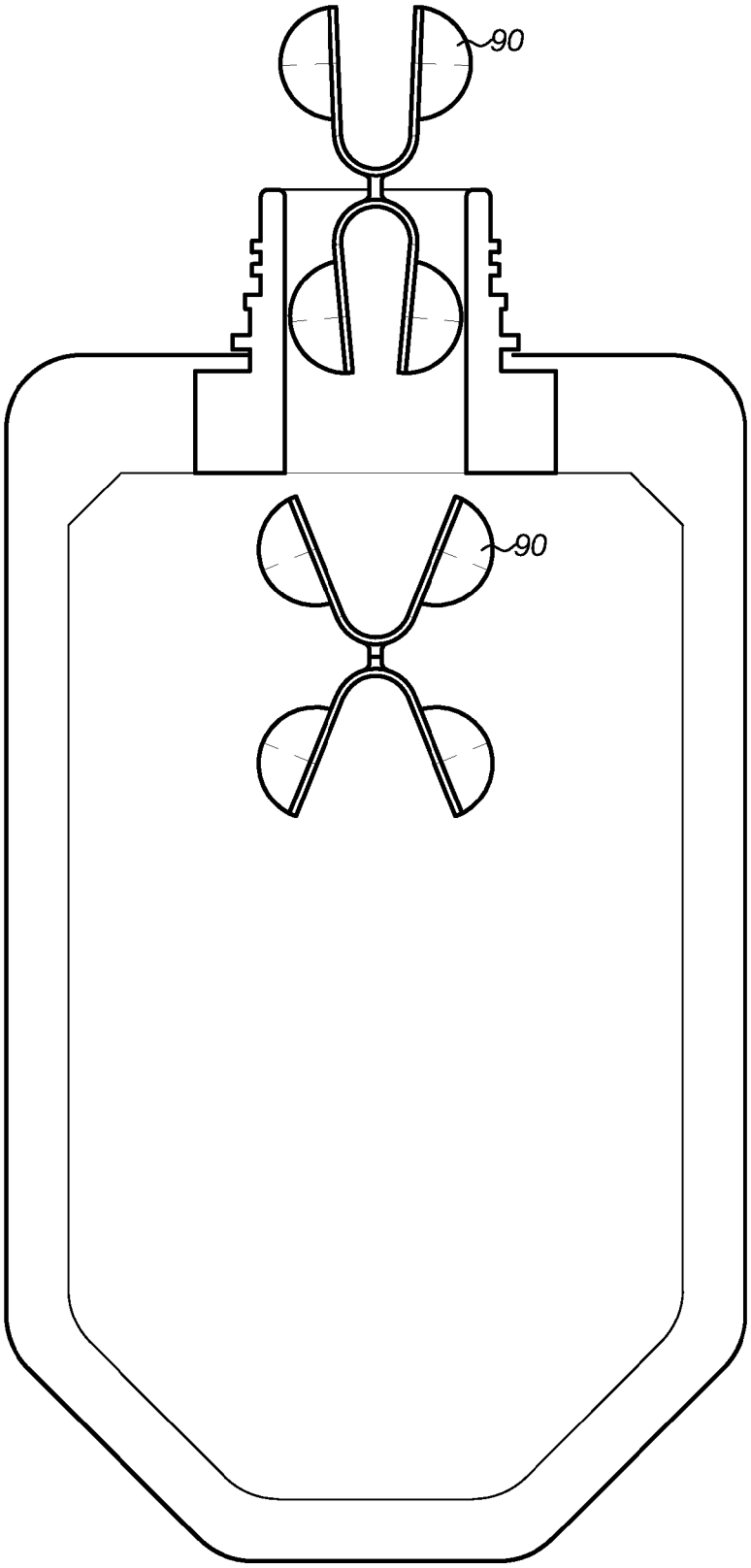
FIG. 9 is a cross sectional view of an example of collapsible and non-retractable mixing device according to an exemplary embodiment of the present invention.

Referring to FIG. 9, a collapsible and retractable device 90 may be inserted into the bag through the spout 16 to enhance mixing. Such device 90, in the collapsible condition, can be made of any appropriate material, typically more dense than the mixed ingredients, that can be collapsed and will retract to the fully expanded condition after entering the bag 13. The expanded device may not exit the bag or block the spout 16 upon drinking or dispensing. Because of the wide opening of the spout 16, the device 90 can be of sufficient mass and configuration to provide the necessary mixing effects depending upon the specific application.

Figure 10:
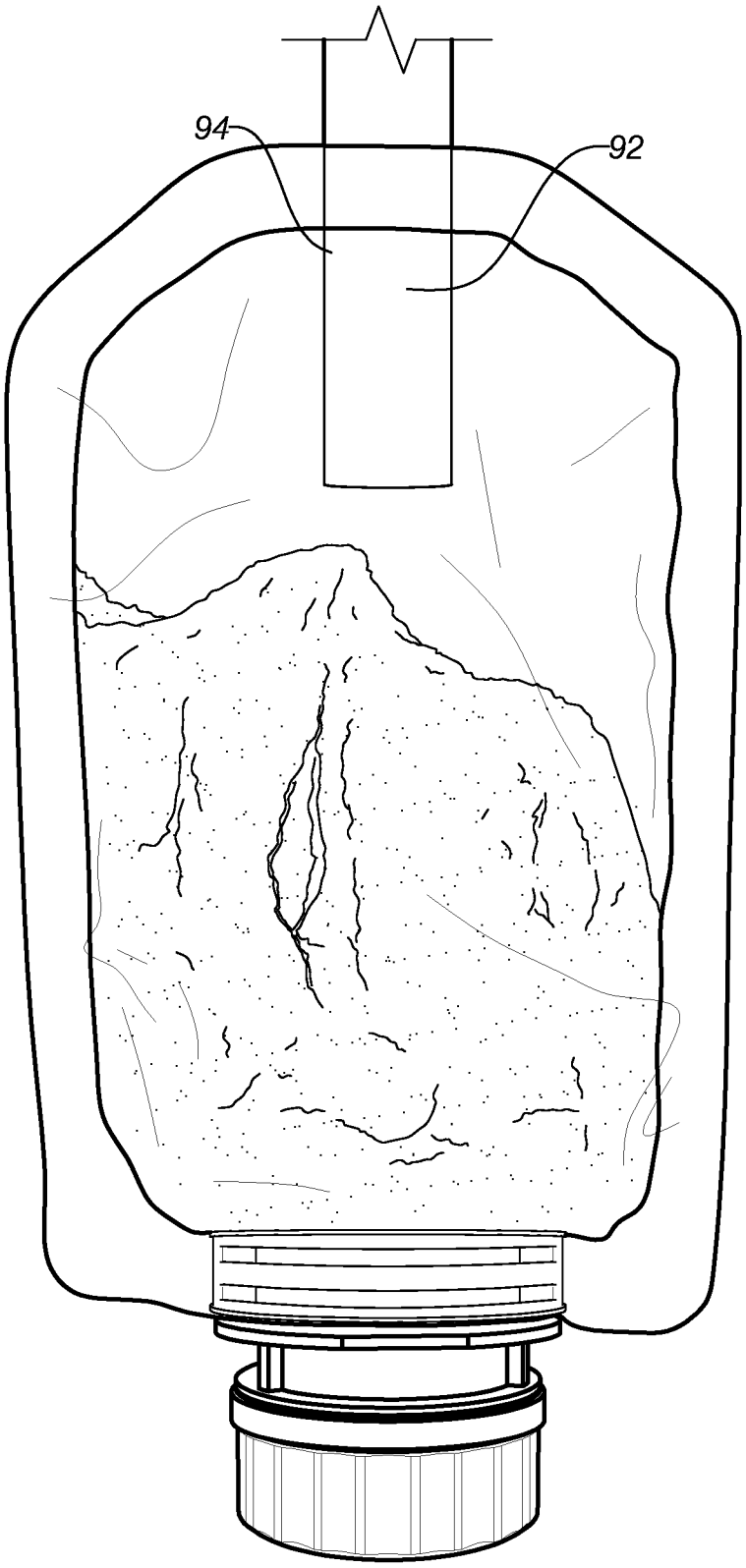
FIG. 10 shows an alternative method to fill the bag from the bottom followed by heat sealing the opening after filling according to an exemplary embodiment of the present invention.

Referring now to FIG. 10, the powdered ingredients may be filled via a filling tube 92 disposed through an opening 94 in the bottom of the bag 13. Once filled with a desired amount of powdered ingredients, the opening 94 may be closed by, for example, heat sealing. This embodiment of the present invention may include the various features and options discussed above.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An assembly for mixing contents therein, comprising:

a bag having an interior for containing a product therein, the bag formed from a front panel and a rear panel;

a spout fluidly connecting with the interior of the bag;

an expandable side gusset forming sides of the bag, the expandable side gusset including a first expandable side gusset connecting first sides of the front panel and the rear panel, and a second side gusset connecting second sides of the front panel and the rear panel; and a linear bottom of the bag that omits a flat surface and lacks gussets, the linear bottom formed from sealing a bottom edge of the front panel and the rear panel together; and a connecting bottom portion of the bag that lacks gussets and extends from the linear bottom at each side thereof, the connecting bottom portion extending upward and away from the linear bottom to connect to the first and second side gussets.

2. The assembly for mixing contents therein of claim 1, further comprising rounded side portions connecting the sides of the bag with the linear bottom.

3. The assembly for mixing contents therein of claim 1, wherein the spout has an internal diameter of at least 15 millimeters.

4. The assembly for mixing contents therein of claim 1, wherein the spout has an internal diameter from about 15 millimeters to about 40 millimeters.

5. The assembly for mixing contents therein of claim 1, further comprising a closure removable disposed on the spout.

6. The assembly for mixing contents therein of claim 5, wherein the closure includes an integrated mixing device extending from the closure, wherein the integrated mixing device extends into the interior of the bag when the closure is placed on the spout.

7. The assembly for mixing contents therein of claim 1, wherein the spout includes an integrated mixing device extending from the spout into the interior of the bag.

8. The assembly for mixing contents therein of claim 1, further comprising a resiliently deformable mixing device that is deformable to fit into the spout and expands within the interior of the bag to prevent the resiliently deformable mixing device from exiting or blocking the spout.

9. The assembly for mixing contents therein of claim 1, further comprising a mixing device removably fitting into the spout and extending into the interior of the bag.

10. The assembly for mixing contents therein of claim 1, wherein the bag is formed from a flexible material.

11. The assembly for mixing contents therein of claim 1, wherein the interior of the bag is formed entirely with rounded corners and lacks any interior angles.

12. An assembly for mixing contents therein comprising:

a bag having an interior for containing a product therein, the bag formed from a front panel and a rear panel;

a spout fluidly connecting with the interior of the bag;

a closure removable disposed on the spout;

an expandable side gusset forming sides of the bag, the expandable side gusset including a first expandable side gusset connecting first sides of the front panel and the rear panel, and a second side gusset connecting second sides of the front panel and the rear panel;

a linear bottom of the bag that omits a flat surface and lacks gussets, the linear bottom formed from sealing a bottom edge of the front panel and the rear panel together; and rounded side portions extending upward and away from the linear bottom to connect connecting to the first and second side gussets of the bag, wherein the spout has an internal diameter of at least 15 millimeters, and at least a portion of the rounded side portions lacks gussets.

13. The assembly for mixing contents therein of claim 12, wherein the closure includes an integrated mixing device extending from the closure, wherein the integrated mixing device extends into the interior of the bag when the closure is placed on the spout.

14. The assembly for mixing contents therein of claim 12, wherein the spout includes an integrated mixing device extending from the spout into the interior of the bag.

15. The assembly for mixing contents therein of claim 12, further comprising a resiliently deformable mixing device that is deformable to fit into the spout and expands within the interior of the bag to prevent the resiliently deformable mixing device from exiting or blocking the spout.

16. The assembly for mixing contents therein of claim 12, further comprising a mixing device removably fitting into the spout and extending into the interior of the bag.

17. The assembly for mixing contents therein of claim 12, wherein the interior of the bag is formed entirely with rounded corners and lacks any interior angles.

18. A mixing assembly comprising:

a bag having an interior for containing a product therein, the bag formed from a front panel and a rear panel;

a spout fluidly connecting with the interior of the bag;

a closure removable disposed on the spout;

an expandable side gusset forming sides of the bag, the expandable side gusset including a first expandable side gusset connecting first sides of the front panel and the rear panel, and a second side gusset connecting second sides of the front panel and the rear panel;

a linear bottom of the bag that omits a flat surface and lacks gussets, the linear bottom formed from sealing a bottom edge of the front panel and the rear panel together;

rounded side portions extending upward and away from the linear bottom to connect to the first and second side gussets of the bag; and a mixing device disposed within the bag, wherein the spout has an internal diameter of at least 15 millimeters, and at least a portion of the rounded side portions lacks gussets.

19. The mixing assembly of claim 18, wherein the mixing device is an integrated mixing device attached to either the closure or the spout and extending into the interior of the bag.

20. The mixing assembly of claim 18, wherein the mixing device is a separate mixing device having at least a portion disposed within the interior of the bag.

* * * * *